US005936392A

United States Patent [19]

Taylor

[11] Patent Number: 5,936,392

[45] Date of Patent: Aug. 10, 1999

[54] CURRENT SOURCE, REFERENCE VOLTAGE GENERATOR, METHOD OF DEFINING A PTAT CURRENT SOURCE, AND METHOD OF PROVIDING A TEMPERATURE COMPENSATED REFERENCE VOLTAGE

[75] Inventor: Clive Roland Taylor, Hertfordshire, United Kingdom

[73] Assignee: VLSI Technology, Inc., San Jose, Calif.

[21] Appl. No.: 08/851,754

[22] Filed: May 6, 1997

[51] Int. Cl.[6] ..... G05F 3/16

[52] U.S. Cl. ..... 323/315; 327/543

[58] Field of Search ..... 327/543, 542, 327/540, 538; 323/312, 313, 315

[56] References Cited

U.S. PATENT DOCUMENTS

| | | | |
|---|---|---|---|
| 4,232,261 | 11/1980 | Lingstaedt et al. | 323/22 |
| 5,030,903 | 7/1991 | Bernard et al. | 323/313 |
| 5,204,612 | 4/1993 | Lingstaedt | 323/317 |
| 5,352,973 | 10/1994 | Audy | 323/313 |
| 5,408,235 | 4/1995 | Doyle et al. | 341/143 |
| 5,424,629 | 6/1995 | Fujiwara et al. | 323/349 |
| 5,448,158 | 9/1995 | Ryat | 323/315 |
| 5,481,180 | 1/1996 | Ryat | 323/315 |
| 5,510,750 | 4/1996 | Cho | 327/546 |
| 5,519,354 | 5/1996 | Audy | 327/512 |
| 5,635,869 | 6/1997 | Ferraiolo | 327/543 |
| 5,781,043 | 7/1998 | Slemmer | 327/78 |

FOREIGN PATENT DOCUMENTS 27 08 022 8/1978 Germany .

*Primary Examiner*—Terry D. Cunningham
*Assistant Examiner*—Marian Hasanzadah
*Attorney, Agent, or Firm*—Wells, St. John, Roberts, Gregory & Matkin, P.S.

[57] ABSTRACT

A PTAT current source comprising a first branch including a bipolar transistor structure connected in diode configuration, and first and second sub-branches coupled to the bipolar transistor structure, the first sub-branch including a p-channel MOSFET transistor connected in diode configuration and an n-channel MOSFET transistor which is not connected in diode configuration, and the second sub-branch including a p-channel MOSFET transistor not connected in diode configuration and an n-channel MOSFET transistor connected in diode configuration; and a second branch including a bipolar transistor structure connected in diode configuration, and third and fourth sub-branches coupled to the bipolar transistor structure, the third sub-branch including a p-channel MOSFET transistor connected in diode configuration and an n-channel MOSFET transistor which is not connected in diode configuration, and the fourth sub-branch including a p-channel MOSFET transistor not connected in diode configuration and an n-channel MOSFET transistor connected in diode configuration; whereby channel length modulation effects caused by MOSFET transistors in the first branch are cancelled by MOSFETS in the second branch.

28 Claims, 4 Drawing Sheets

CURRENT SOURCE, REFERENCE VOLTAGE GENERATOR, METHOD OF DEFINING A PTAT CURRENT SOURCE, AND METHOD OF PROVIDING A TEMPERATURE COMPENSATED REFERENCE VOLTAGE

TECHNICAL FIELD

The invention relates to current sources. The invention also relates to bandgap reference voltage generators.

BACKGROUND OF THE INVENTION

Band gap reference generators are known in the art. See, for example, *Analysis and Design of Analog Integrated Circuits*, Paul R. Gray and Robert G. Meyer, Third Edition, John Wiley & Sons. Band gap reference generators produce a reference voltage. The reference voltage produced is approximately equal to the band gap voltage of silicon, which is approximately 1.2 Volts. Band gap reference voltage generators are intended to generate a voltage output that is not significantly affected by power supply and temperature fluctuations.

FIG. 1 shows a known band-gap reference voltage generator 10. The bandgap reference voltage generator 10 shows two (bipolar) pnp structures 12 and 14 in first and second branches, respectively. The pnp structure 14 is actually made up of twenty-four pnp transistors in parallel, while the pnp structure 12 is made up of just one transistor. If equal currents are forced down each of these branches, there will be a larger base-emitter voltage drop across the pnp 12 in the branch where there is just one transistor. In the branch where there are twenty-four transistors in parallel there will be a much lower base-emitter voltage drop because of an increased base-emitter area. Using a well known relationship, the expected difference in the voltage drop can be determined if an equal current is passed down to pnp structures 12 and 14 of different sizes.

The circuit 10 further includes an operational amplifier 16 having a non-inverting input Inp coupled to the first branch, an inverting input Inn coupled to the second branch, and an output. The circuit 10 further includes a transistor m7 having a gate coupled to the output of the operational amplifier 16, having a drain coupled to a supply voltage, and having a source. The circuit 10 generates an output reference voltage vref, at the top of the first and second branches, coupled to the source of the transistor m7.

The aim of the circuit 10 is to find a current such that the input points Inp and Inn of the operational amplifier 16 will have equal voltages. Thus, a resistor r1 is provided in the second branch between the inverting input Inn and the transistor 14, to provide a voltage drop that compensates for the lower voltage drop of the multiple parallel transistors in the second branch that make up the transistor 14.

A band gap reference voltage generator ideally has a zero temperature coefficient. The temperature coefficient of pnp transistors, which is the change in base-emitter voltage relative to temperature, is approximately −2.2 milliVolts per degree Celsius. On the other hand, the temperature coefficient for the voltage dropped across resistor r1 is positive, and is approximately 0.270 milliVolts per degree Celsius. Therefore, it is desirable to multiply up the temperature coefficient of the voltage dropped across the r1 resistor such that the temperature coefficient is equal to that of the base-emitter voltage across a pnp transistor, to thereby provide a net zero temperature coefficient. The way this is done is by providing a resistor r2 in the second branch between the source of the transistor m7 and the inverting input. The resistor r2 is equal in resistance to some multiple of r1. For example, the resistor r2 can be made up of multiple of the resistors r1 in series, providing a resistance equal to the sum of the series resistances. Because equal currents are desired in both branches, the resistance of resistor r3 equals the resistance of resistor r2 (current equals voltage divided by resistance, and both resistors are coupled to the same voltage, vref).

In order to have temperature coefficients cancel each other, that value of r3 is equal to approximately eight times the resistance of resistor r1. The ideal voltage desired for the vref value is 1.25 Volts, which is the silicon band gap value. The characteristic curve of voltage over temperature is centered such that between about −40° C. and +85° C. there is little change in the vref value. Because ambient temperature varies only slightly within that range, the circuit shown in FIG. 1 is satisfactory for many purposes.

The operational amplifier 16 turns on transistor m7 until the voltages of the inputs Inn and Inp of the operational amplifier are equal, and it then holds. The voltage dropped across the resistor r1 then compensates for the larger (times twenty-four) pnp structure 14.

A problem with using the classical band gap reference voltage generator of FIG. 1 is that it includes an operational amplifier. Use of an operational amplifier involves high current consumption in the order of say hundreds of microAmps. For battery powered situations, where it is desired to use a band gap reference voltage generator, it is difficult to have minimum current consumption when an operational amplifier is being used. Further, operational amplifiers have their own temperature coefficients, so the circuit of FIG. 1 does not have the ideal temperature coefficient characteristic. Further, the operational amplifier must be well designed—voltage offset must be minimal, the current sources in the operational amplifier must matched, and there are also channel length modulation effects to counteract.

FIG. 2 shows another band gap reference voltage generator circuit 18. The circuit 18 includes a PTAT (Proportional To Absolute Temperate) current source including first and second branches 20 and 24. The branch 20 includes a pnp structure 26 made up of a single transistor, and the branch 24 includes a pnp structure 28 having thirteen pnp transistors. The circuit 18 includes a CMOS implementation of a bipolar PTAT current source.

The circuit 18 includes a p-channel transistor 30 in the first branch 20, a p-channel transistor 32 in the second branch 24, an n-channel transistor 34 in the first branch 20, and an n-channel transistor 36 in the second branch 24. These transistors have a current loop gain of one. In other words, in the stable state there are equal currents in the branches 20 and 24, and the loop gain is equal to one. The second branch 24 includes a resistor 38 coupled between the transistor 36 and the pnp structure 28 similar to the resistor r1 of FIG. 1. At power-up, the loop gain is greater than one. Current increases and increases until the voltage dropped across the resistor 28 exactly compensates for the larger pnp structure.

A positive temperature coefficient is defined by the voltage drop across the resistor 38. The branches 20 and 24 define a PTAT current source. The circuit 18 further includes a current mirror 40 which mirrors the current from the PTAT current source. The current mirror 40 has a times ten resistor ladder 41 defined by resistors 42, 44, 46, 48, 50, 52, 54, 56, 58, and 60. The temperature coefficient across this resistor ladder 41 is 0.218 milliVolts×10 per degree Celsius which is equal to approximately 2.2 milliVolts per degree Celsius. As mentioned above, the temperature coefficient of pnp transistors is approximately −2.2 milliVolts per degree Celsius. Therefore, the circuit 18 includes a pnp structure 62 coupled to the resistor ladder and having a temperature coefficient of −2.2 millivolts per degree Celsius. In the illustrated embodiment, the pnp structure 62 is made up of twenty-eight pnp transistors in parallel. When the pnp structure 62 is coupled to the resistor ladder, the negative temperature coefficient of the pnp transistor (−2.2 millivolts) cancels the positive temperature coefficient of the resistor ladder (2.2 millivolts) and therefore the output reference voltage Vref will effectively have a zero temperature coefficient.

An advantage of using the circuit 18 is that, to produce an output voltage exactly to 1.25 Volts (bandgap voltage), the base to emitter voltage drop across the structure 62 can be adjusted (e.g., by varying the transistor size) until the desired voltage of 1.25 Volts is achieved. This is possible because the −2.2 milliVolt temperature coefficient of the structure 62 is more or less independent of pnp transistor size.

A drawback of the circuit 18 is that the mirrored current in the unity gain circuit does not have a loop gain equal to one due to channel length modulation effects. Although current mirror loop gain should be one, it could be slightly higher than one, so the voltage drop across the resistor 38 would not have the correct value. This results in the output voltage, vref, having a value that varies from its intended value, and results in variation in the value of the output voltage, vref. Some attempts to solve this problem have involved cascading the current sources, but this results in the minimum voltage being increased significantly.

Another problem with the circuit 18 of FIG. 2 is that output current is very small, and does not have the ability to drive as much circuitry as the op-amp circuit of FIG. 1. The applications for band gap reference voltage generators of the type of FIG. 2 are very low power circuits, such as where current consumption is below 20 microAmps.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
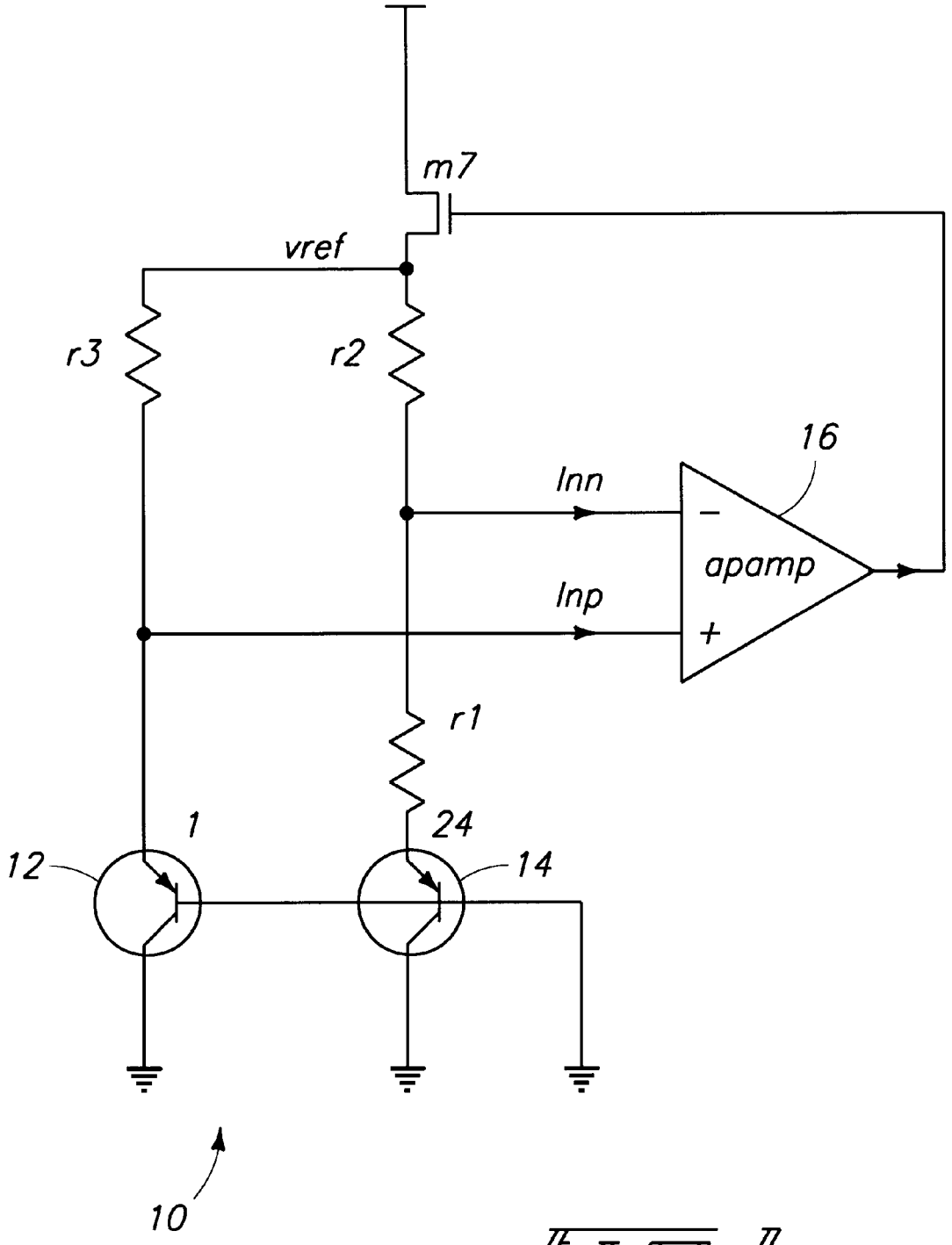
FIG 1 PRIOR ART
FIG. 1 is a circuit schematic of a prior art bandgap reference voltage generator that employs an operational amplifier.
Figure 2:
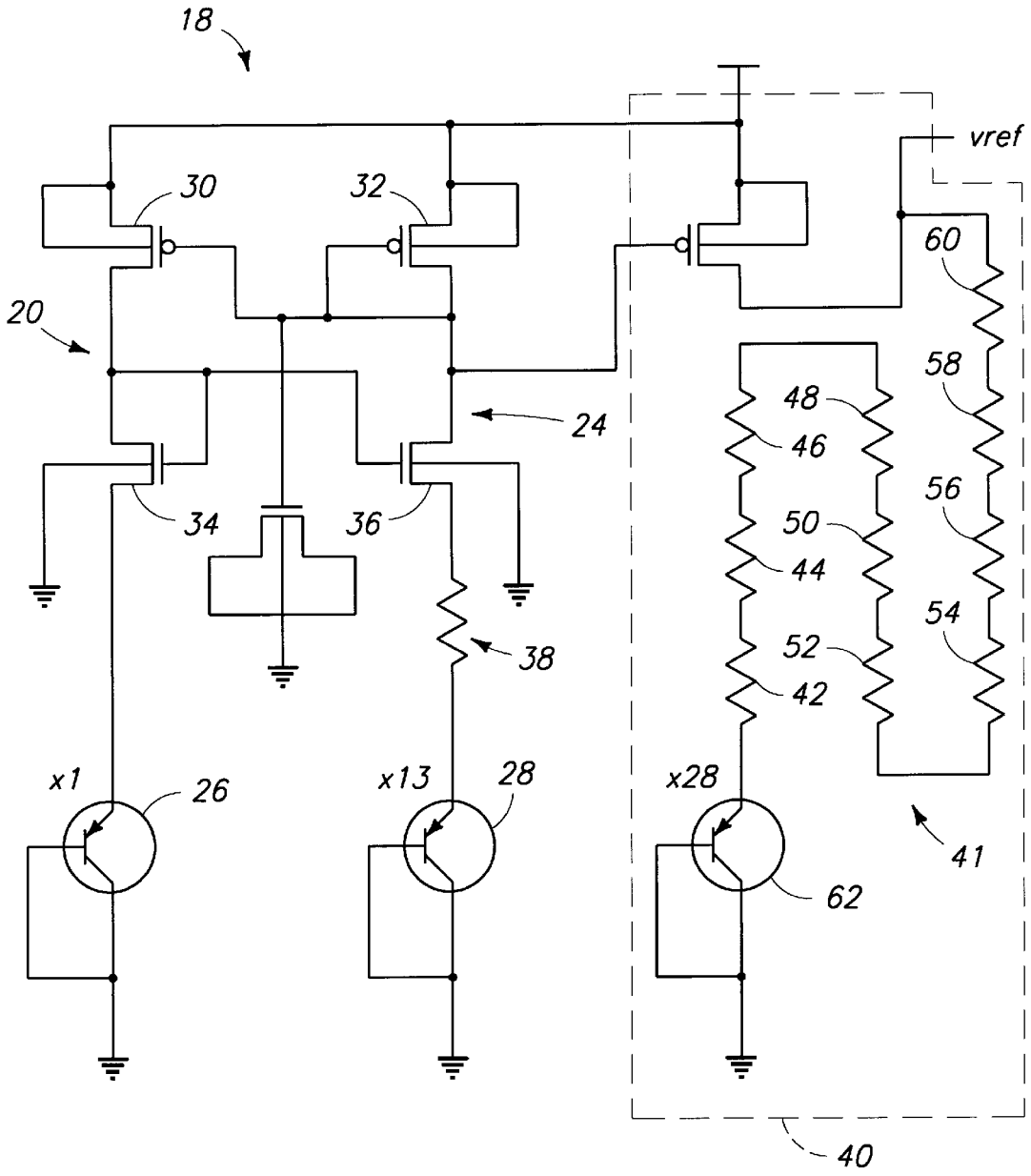
Fig 2 PRIOR ART
FIG. 2 is a circuit schematic of a prior art bandgap reference voltage generator that does not employ an operational amplifier.

This disclosure of the invention is submitted in furtherance of the constitutional purposes of the U.S. Patent Laws "to promote the progress of science and useful arts" (Article 1, Section 8).

The invention provides a current source for producing a current that is proportional to absolute temperature. More particularly, the invention provides a PTAT current source section including two branches having similarly configured transistors in both branches.

One aspect of the invention provides a PTAT current source comprising a first branch including a bipolar transistor structure connected in diode configuration, and first and second sub-branches coupled to the bipolar transistor structure, the first sub-branch including a p-channel MOSFET transistor connected in diode configuration and an n-channel MOSFET transistor which is not connected in diode configuration, and the second sub-branch including a p-channel MOSFET transistor not connected in diode configuration and an n-channel MOSFET transistor connected in diode configuration; and a second branch including a bipolar transistor structure connected in diode configuration, and third and fourth sub-branches coupled to the bipolar transistor structure, the third sub-branch including a p-channel MOSFET transistor connected in diode configuration and an n-channel MOSFET transistor which is not connected in diode configuration, and the fourth sub-branch including a p-channel MOSFET transistor not connected in diode configuration and an n-channel MOSFET transistor connected in diode configuration; whereby channel length modulation effects caused by MOSFET transistors in the first branch are cancelled by MOSFETS in the second branch.

Another aspect of the invention provides a reference voltage generator comprising a first branch including a bipolar transistor structure connected in diode configuration, and first and second sub-branches coupled to the bipolar transistor structure, the first sub-branch including a p-channel MOSFET transistor connected in diode configuration and an n-channel MOSFET transistor which is not connected in diode configuration, and the second sub-branch including a p-channel MOSFET transistor not connected in diode configuration and an n-channel MOSFET transistor connected in diode configuration; a second branch including a bipolar transistor structure connected in diode configuration, and third and fourth sub-branches coupled to the bipolar transistor structure, the third sub-branch including a p-channel MOSFET transistor connected in diode configuration and an n-channel MOSFET transistor which is not connected in diode configuration, and the fourth sub-branch including a p-channel MOSFET transistor not connected in diode configuration and an n-channel MOSFET transistor connected in diode configuration; and a voltage output coupled to the first and second branches.

Another aspect of the invention provides a PTAT current source comprising first and second branches respectively having MOSFET transistors, the MOSFET transistors of the first branch including a p-channel transistor connected in diode configuration, a p-channel transistor not connected in diode configuration, an n-channel transistor connected in diode configuration, and an n-channel transistor not connected in diode configuration, the MOSFET transistors of the second branch including a p-channel transistor connected in diode configuration, a p-channel transistor not connected in diode configuration, an n-channel transistor connected in diode configuration, and an n-channel transistor not connected in diode configuration, the MOSFET transistors of the first and second branches together defining first and second opposing feedback loops which converge at a common node.

Another aspect of the invention provides a method of defining a PTAT current source, the method comprising providing first and second branches respectively having MOSFET transistors, and arranging the MOSFET transistors such that channel length modulation effects caused by MOSFET transistors in the first branch are cancelled by MOSFETS in the second branch, and such that the MOSFET transistors of the first and second branches together define first and second opposing feedback loops which converge at a common node.

Another aspect of the invention provides a method of providing a temperature compensated reference voltage, the method comprising defining a PTAT current source comprising first and second branches respectively having MOSFET transistors, and arranging the MOSFET transistors such that channel length modulation effects caused by MOSFET transistors in the first branch are cancelled by MOSFETS in the second branch, and such that the MOSFET transistors of the first and second branches together define first and second opposing feedback loops which converge at a common node; and mirroring current from the common node to an output branch including a resistor in series with a diode connected bipolar transistor.

Another aspect of the invention provides a method of providing a temperature compensated reference voltage, the method comprising defining a PTAT current source comprising first and second branches respectively having MOSFET transistors, the MOSFET transistors of the first branch including a p-channel transistor connected in diode configuration, a p-channel transistor not connected in diode configuration, an n-channel transistor connected in diode configuration, and an n-channel transistor not connected in diode configuration, the MOSFET transistors of the second branch including a p-channel transistor connected in diode configuration, a p-channel transistor not connected in diode configuration, an n-channel transistor connected in diode configuration, and an n-channel transistor not connected in diode configuration, the MOSFET transistors of the first and second branches together defining first and second opposing feedback loops which converge at a common node; and mirroring current from the common node to an output branch including a resistor in series with a diode connected bipolar transistor.

Figure 3:
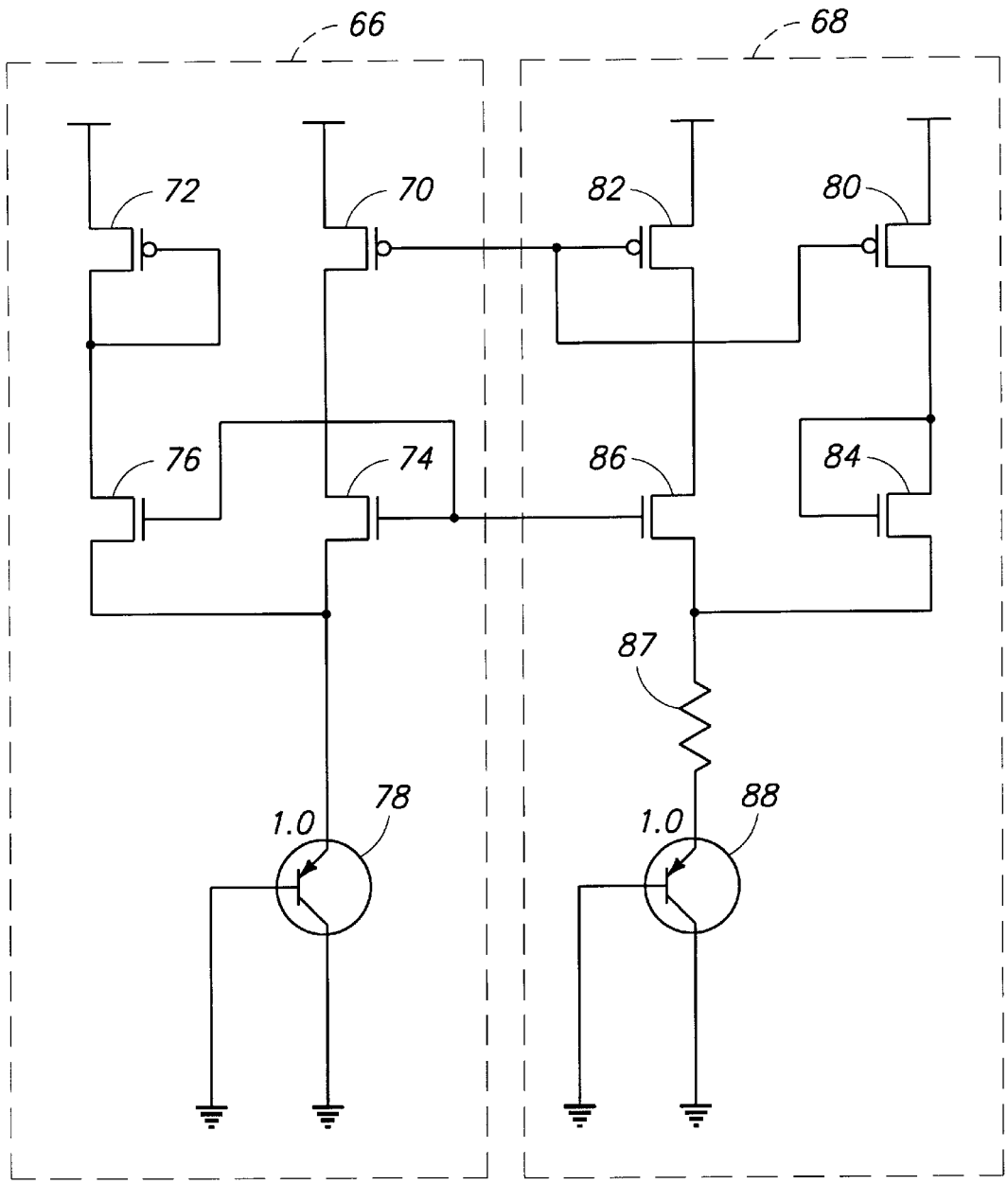
FIG. 3 is a circuit schematic of a simplified circuit, illustrating a method of cancelling channel length modulation effects in accordance with one aspect of the invention.

FIG. 3 shows circuitry 64 including a first branch 66 and a second branch 68. The first branch 66 includes a p-channel transistor 70 (not connected in a diode configuration) and another p-channel transistor 72 connected in diode configuration. Likewise, the first branch 66 includes one n-channel transistor 74 connected in a diode configuration, and another n-channel transistor 76 connected in a non-diode configuration. These transistors are coupled to a bipolar pnp structure 78.

The second branch 68 has a similar configuration. More particularly, the second branch 68 includes a p-channel transistor 80 (not connected in a diode configuration) and another p-channel transistor 82 connected in diode configuration. Likewise, the second branch 68 includes one n-channel transistor 84 connected in a diode configuration, and another n-channel transistor 86 connected in a non-diode configuration. These transistors are coupled to a bipolar pnp structure 88 via a resistor 87. By having matching transistor configurations in the two branches, channel modulation effects are cancelled out. In the circuit 64, branches 66 and 68 are split into two sub-branches or portions.

However, the circuit of FIG. 3 does not completely solve the problem because the extra sub-branches are not included in the loop gain of the circuit 64. Loop gain is still $1+\delta$. However, if two opposing loop gains start and finish from the same source, then their point of equilibrium can only be when both loop gains equal one.

Figure 4:
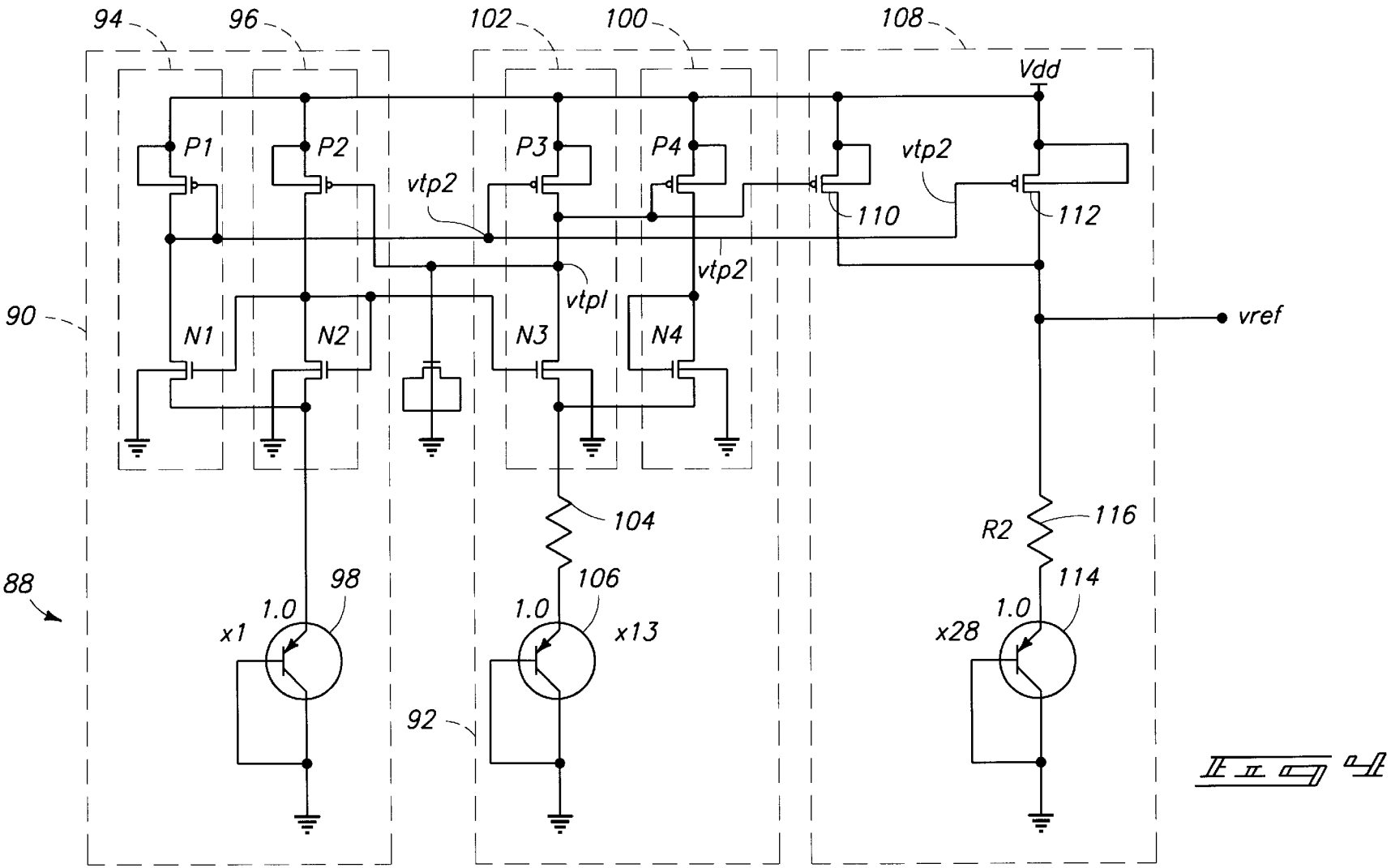
FIG. 4 is a circuit schematic of a bandgap reference voltage generator in accordance with one embodiment of the invention.

FIG. 4 shows a circuit 88 that brings the extra sub-branches into the overall loop gain. The circuit 88 includes a first branch 90, and a second branch 92.

The branch 90 includes two sub-branches 94 and 96. The sub-branch 94 includes a p-channel MOSFET P1 having a source, drain, and gate, and an n-channel MOSFET N1, having a drain coupled to the drain of the transistor P1, having a source, and having a gate. The sub-branch 96 includes a p-channel MOSFET P2 having a source, drain, and gate, and an n-channel MOSFET N2, having a drain coupled to the drain of the transistor P2 and to the gate of the transistor N1, having a source, and having a gate coupled to the gate of the transistor N1 and to the drain of the transistor P2.

The first branch 90 further includes a bipolar pnp transistor 98 having an emitter coupled to the source of the transistor N2 (and the source of the transistor N1), having a collector coupled to ground, and having a base coupled to its collector.

The branch 92 includes two sub-branches 100 and 102. The sub-branch 100 includes a p-channel MOSFET P4 having a source, drain, and gate, and an n-channel MOSFET N4, having a drain coupled to the drain of the transistor P4, having a source, and having a gate. The sub-branch 102 includes a p-channel MOSFET P3 having a source, drain, and gate. The sub-branch 102 further includes an n-channel MOSFET N3 having a drain coupled to the drain of the transistor P3 and to the gate of the transistor P2, having a source coupled to the source of the transistor N4, and having a gate coupled to the gate of the transistor N1.

The branch 92 further includes a bipolar pnp structure 106 having thirteen of the transistors 98 coupled together in parallel, respectively having an emitter, having a collector coupled to ground, and having a base coupled to its collector. In the branch 92, where there are thirteen transistors in parallel, there will be a much lower base-emitter voltage drop than in the branch 90 because of an increased base-emitter area of the bipolar structure 106 relative to the bipolar structure 98.

The bipolar structures 98, 106, and 114 in FIG. 4 respectively comprise pnp transistors that occur naturally in the n-well CMOS process that is employed.

The branch 92 further includes a resistor 104 coupled between the source of the transistor N3 and the emitter of the transistor 106. The bipolar transistor structures 98 and 106 are respectively connected in diode configuration and are used to arrive at a voltage drop across the resistor 104.

It is known that if two identical bipolar transistors have different currents passed through them, the difference in their $V_{BE}$ values is equal to $VT \times \ln(Ic1/Ic2)$ where VT is thermal voltage, Ic1 is the current through one branch (through one bipolar transistor), and Ic2 is the current through the other branch (through the other bipolar transistor). See, for example, a discussion of Widlar current sources in *Micro-Electronic Circuits*, Adel S. Sedra and Kenneth C. Smith, published by Holt, Rinehart and Winston, 1982, pp. 592–593. See also a discussion of Widlar current sources in *Analysis and Design of Analog Integrated Circuits*, Third Edition, Paul R. Gray and Robert G. Meyer, published by John Wiley & Sons, Inc., 1993, p. 277. It follows that if identical currents are passed through bipolar transistor structures of different sizes, the difference in their $V_{BE}$ values is equal to $VT \times \ln(S1/S2)$ where VT is thermal voltage, S1 is the emitter area of one bipolar transistor and S2 is the emitter area of the other bipolar transistor. This forms the basis of a bipolar PTAT current source, because the voltage drop across the resistor 104, which voltage is equal to the current passing through the transistor structure 106 multiplied by the resistance of the resistor 104, is directly proportional to VT=kT/q. In other words, the voltage drop across the resistor 104 is directly proportional to absolute temperature.

Thus, in the illustrated embodiment, the voltage drop is VT×ln(13/1), where VT is thermal voltage. The natural logarithm of 13 is taken, in the illustrated embodiment, because the bipolar transistor structure 106 includes thirteen of the bipolar transistors 98 in parallel so the emitter area of the bipolar structure 106 is thirteen times the area of the bipolar transistor 98. The voltage drop, in the illustrated embodiment, is VT×ln (13)=0.026×2.56=67 mV (PTAT current source bipolar characteristic). The circuitry therefore behaves as if it were built with bipolar transistors. The circuitry uses the ratio of emitter areas of the bipolar structure 106 relative to the bipolar structure 98. In the illustrated embodiment, the ratio of emitter areas of the structure 92 relative to the structure 98 is 13:1.

The circuit 88 includes a path from N2 to N1 to P1 to P3 which acts on a point or node vtp1, and a path from N2 to N3 that also acts on the node vtp1. Both these paths act against each other. More particularly, the transistor N2 mirrors current in two directions to act with opposing polarity on the node vtp1. The two paths act against each other and their equilibrium is going to be when the currents produced from the paths at the node vtp1 are equal and opposite. The point vtp1 then acts on transistor P2 which feeds transistor N2. More particularly, loop gain is completed by a common path vtp1 to P2 to N2. Thus, both paths act on the same node and feed N2. The only way they can be in equilibrium is when the current in P3 (which is affected by the path N2, N1, P1, P3) is equal to the current through N3 (which is affected by the path N2 to N3 acting on vtp1). When equal currents pass through the transistors P3 and N3, that is the equilibrium state. The voltage at the node vtp1 is very nearly equal to the voltage at a node vtp2. Channel length modulation causes the voltage at node vtp1 to equal the voltage at the node vtp2 plus a delta value of typically a few milliVolts. Thus, the difference in the voltage between the points vtp1 and vtp2 is typically a few milliVolts. The relative currents become I(P1)=I(P2)+δ, and I(P3)=I(P4)+δ.

Equilibrium is reached when current entering the node vtp1 is equal to the current leaving the node vtp1 (making both loop gains equal). This in turn forces the loop gain of the loop N2, N3, P3, P2, N2 to unity with the following transistor matching: the P1/N1 configuration matches with P3/N3 (because the voltage at vtp1 is almost equal to the voltage of vtp2), and the P2/N2 configuration matches with P4/N4.

More particularly, in the branch 90, the transistor P1 is connected in diode configuration, and transistor P2 is not connected in diode configuration. In the branch 92, the transistor P3 operates effectively as a diode because the voltage at node vtp2 is substantially equal to the voltage at the node vtp1. The transistor P4 is not connected in diode configuration. Thus, there is a balanced configuration of p-channel transistors.

There is a similar balance with the n-channel transistors. In the branch 90, transistor N2 is connected in diode configuration, and transistor N1 is not configured in diode configuration. In the branch 92, transistor N4 is connected in diode configuration and transistor N3 is not connected in diode configuration.

Thus, the two branches 90 and 92 have equal and opposite configurations with respect to n-channel and p-channel transistors that are or are not connected in diode configuration. This results in cancellation of channel length modulation effects, and also provides for tolerance of much lower voltages. As voltage is lowered, if the transistors which are not in the diode configuration then start to go into say the non-linear region, if the transistors are well matched there will be little effect on the loop gain of the circuit because there are balanced transistors in the other branch. For example, if the transistor P2 goes into a slightly non-linear region, then the transistor P4 will also be in the slightly non-linear region, so there will still be equal currents on both sides. If the transistor N1 goes into a slightly non-linear region, the transistor N3 also will. The transistors balance so the currents produced will be equal. The conditions for identical currents in both branches are met: I(P1)+I(P2)=I(P3)+I(P4). Further, the transistors N2 and N4 are connected in diode configuration. Even down to voltages of 1.7 Volts, or even 1.5 Volts (depending on technology), a minimal change in vref results. For example, a voltage drop from 3.3 Volts to 1.7 Volts results in a change of only about 0.2 milliVolts, which is extremely small. As the supply is further reduced and the non-linear region is traversed, vtp1=vtp2+δ (10s of milliVolts), at which point $VDD_{min}$ should be defined (i.e., now I(P1)=I(P2)−δ and I(P3)=I(P4)−δ. When vtp1<vtp2, the circuit starts to lose its accuracy.

Thus, the circuitry 88 includes a PTAT current source comprising two opposing feedback loops which converge at vtp1.

The circuitry 88 further includes current mirror circuitry 108. The circuitry 108 includes two transistors 110 and 112 mirroring current produced at the nodes vtp1 and vtp2, respectively, to cancel out the effect of the very slight difference between the voltages at the nodes vtp1 and vtp2. The transistor 110 includes a source, a gate coupled to the node vtp1, and a drain defining an output vref, where a bandgap reference voltage is produced. The transistor 112 includes a source coupled to the sources of the transistors P1, P2, P3, P4, and 110; and a gate coupled to the node vtp2. The sources of the transistors 112, P1, P2, P3, P4, and 110 are all coupled to a supply voltage Vdd. The output vref is supply voltage independent. Any voltage supply Vdd can be supplied within process defined limits. The transistor 112 further includes a drain coupled to the drain of the transistor 110. The circuitry 108 further includes a bipolar pnp structure 114 having thirteen of the transistors 98 coupled together in parallel, respectively having an emitter, having a collector coupled to ground, and having a base coupled to its collector. The circuitry 108 further includes a resistor 116 which is made up of ten of the resistors 104 in series, and which is coupled between the emitter of the structure 114 and the output vref.

Any error produced in the circuitry 108 is most likely going to be caused by the current being mirrored from the circuitry 90. However, it has been determined that the voltage vref is very close to the voltage on the drain/gate node of the transistor N2. Discrepancies caused by the current mirroring occurs in a non-critical part of the circuitry 108; namely, outside of the loops of the branches 90 and 92. An error of about 1% can be tolerated.

The temperature coefficient of the pnp transistor 98 is approximately −2.2 millivolts per degree Celsius. The temperature coefficient of the pnp transistor 106 is approximately −2.2 milliVolts per degree Celsius. On the other hand, the temperature coefficient for the voltage dropped across the resistor 104 is positive, and is approximately 0.085 mV×ln(13)=0.022 millivolts. The temperature coefficient of the voltage dropped across the resistor 116 is therefore 2.2 millivolts per degree Celsius (i.e. ten times the temperature coefficient for the resistor 104) which cancels out the $V_{BE}$ temperature coefficient of −2.2 millivolts per degree Celsius of the bipolar transistor 106. Therefore, vref is temperature independent and is equal to ten times the voltage drop across the resistor 104 plus $V_{BE}$ of the transistor structure 114, which equals 1.27 Volts.

Thus, circuitry has been disclosed which overcomes channel length modulation effects, and which compensates for temperature coefficients. The circuitry can be effectively employed in a band gap reference generator. The invention also provides an extremely accurate PTAT current source in CMOS technology using very small size transistors. The invention further provides for a lower operating voltage than would normally be seen using prior art circuitry.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A PTAT current source comprising:

a first branch including a bipolar transistor structure configured to act as a diode, and first and second sub-branches coupled to the bipolar transistor structure, the first sub-branch including a p-channel MOSFET transistor configured to act as a diode and an n-channel MOSFET transistor which is not configured to act as a diode, and the second sub-branch including a p-channel MOSFET transistor not configured to act as a diode and an n-channel MOSFET transistor configured to act as a diode; and a second branch coupled to the first branch, and including a bipolar transistor structure configured to act as a diode, and third and fourth sub-branches coupled to the bipolar transistor structure, the third sub-branch including a p-channel MOSFET transistor configured to act as a diode and an n-channel MOSFET transistor which is not configured to act as a diode, and the fourth sub-branch including a p-channel MOSFET transistor not configured to act as a diode and an n-channel MOSFET transistor configured to act as a diode; the p-channel MOSFET transistor of the second sub-branch having a gate defining a first node, the p-channel MOSFET transistor of the first sub-branch having a gate defining a second node, the p-channel MOSFET transistor of the third sub-branch having a gate coupled to the second node, the p-channel MOSFET transistor of the fourth sub-branch having a gate coupled to the first node; and current mirror circuitry including a first transistor, having a gate coupled to the first node, configured to mirror current produced at the first node, and including a second transistor, having a gate coupled to the second node, configured to mirror current produced at the second node, the first and second transistors of the current mirror being coupled together to cancel differences in voltages at the first and second nodes, in operation, and to define an output where the bandgap reference voltage is produced.

2. A PTAT current source in accordance with claim 1 and further comprising a resistor in the second branch, coupled between the bipolar structure of the second branch and the third and fourth sub-branches, and wherein the bipolar transistor structure of the second branch comprises in parallel a multiple of bipolar transistors of the size of the bipolar transistor structure in the first branch.

3. A PTAT current source in accordance with claim 1 and further comprising a resistor in the second branch, coupled between the bipolar structure of the second branch and the third and fourth sub-branches, and wherein the bipolar transistor structure of the second branch comprises in parallel thirteen bipolar transistors of the size of the bipolar transistor structure in the first branch.

4. A PTAT current source in accordance with claim 1 wherein the MOSFETS in the first and second branches define first and second current feedback loops acting in opposite directions on a common node.

5. A PTAT current source in accordance with claim 1 wherein the number of MOSFETS in the first branch is exactly equal to the number of MOSFETS in the second branch.

6. A PTAT current source in accordance with claim 1 and further comprising a resistor in the second branch coupled between the bipolar transistor structure of the second branch and the third sub-branch.

7. A PTAT current source in accordance with claim 6 wherein the p-channel transistor of the second sub-branch has a source and drain, and wherein the n-channel transistor of the second sub-branch has a drain coupled to the drain of the p-channel transistor of the second sub-branch.

8. A PTAT current source in accordance with claim 7 wherein the p-channel transistor of the third sub-branch has a source and drain, and wherein the n-channel transistor of the third sub-branch has a drain coupled to the drain of the p-channel transistor of the third sub-branch.

9. A PTAT current source in accordance with claim 8 wherein the p-channel transistor of the first sub-branch has a source and drain, and wherein the n-channel transistor of the first sub-branch has a drain coupled to the drain of the p-channel transistor of the first sub-branch.

10. A PTAT current source in accordance with claim 9 wherein the p-channel transistor of the fourth sub-branch has a source and drain, and wherein the n-channel transistor of the fourth sub-branch has a drain coupled to the drain of the p-channel transistor of the fourth sub-branch.

11. A PTAT current source in accordance with claim 10 wherein the sources of the p-channel transistors of the first, second, third, and fourth sub-branches are coupled together, wherein the source of the n-channel transistor of the first sub-branch is coupled to the source of the n-channel transistor of the second sub-branch, and wherein the source of the n-channel transistor of the third sub-branch is coupled to the source of the n-channel transistor of the fourth sub-branch.

12. A reference voltage generator comprising:

a first branch including a bipolar transistor structure configured to act as a diode, and first and second sub-branches coupled to the bipolar transistor structure, the first sub-branch including a p-channel MOSFET transistor configured to act as a diode and an n-channel MOSFET transistor which is not configured to act as a diode configuration, and the second sub-branch including a p-channel MOSFET transistor not configured to act as a diode and an n-channel MOSFET transistor configured to act as a diode;

a second branch, coupled to the first branch, and including a bipolar transistor structure configured to act as a diode, and third and fourth sub-branches coupled to the bipolar transistor structure, the third sub-branch including a p-channel MOSFET transistor configured to act as a diode and an n-channel MOSFET transistor which is not configured to act as a diode, and the fourth sub-branch including a p-channel MOSFET transistor not configured to act as a diode and an n-channel MOSFET transistor configured to act as a diode, the p-channel MOSFET transistor of the second sub-branch having a gate defining a first node, the p-channel MOSFET transistor of the first sub-branch having a gate defining a second node, the p-channel MOSFET transistor of the third sub-branch having a gate coupled to the second node, the p-channel MOSFET transistor of the fourth sub-branch having a gate coupled to the first node; and current mirror circuitry including a first transistor having a gate coupled to the first node, configured to mirror current produced at the first node, and including a second transistor, having a gate coupled to the second node, configured to mirror current produced at the second node, the first and second transistors of the current mirror being coupled together to cancel differences in voltages at the first and second nodes and to define a voltage output.

13. A reference voltage generator in accordance with claim 12 wherein the current mirror circuitry further includes a bipolar transistor configured to act as a diode, and a resistor coupled between the bipolar transistor and the output.

14. A reference voltage generator in accordance with claim 12 and which, in operation generates, at the output, a voltage that is substantially independent of temperature.

15. A reference voltage generator in accordance with claim 12 and further comprising a resistor in the second branch, coupled between the bipolar structure of the second branch and the third and fourth sub-branches, and wherein the bipolar transistor structure of the second branch comprises in parallel a multiple of bipolar transistors of the size of the bipolar transistor structure in the first branch.

16. A reference voltage generator in accordance with claim 12 and further comprising a resistor in the second branch, coupled between the bipolar structure of the second branch and the third and fourth sub-branches, and wherein the bipolar transistor structure of the second branch comprises in parallel thirteen bipolar transistors of the size of the bipolar transistor structure in the first branch.

17. A reference voltage generator in accordance with claim 12 wherein the MOSFETS in the first and second branches define first and second current feedback loops acting in opposite directions on a common node, and wherein the voltage output is coupled to the common node.

18. A reference voltage generator in accordance with claim 12 wherein the number of MOSFETS in the first branch is exactly equal to the number of MOSFETS in the second branch.

19. A reference voltage generator in accordance with claim 12 and further comprising a resistor in the second branch coupled between the bipolar transistor structure of the second branch and the third sub-branch.

20. A reference voltage generator in accordance with claim 19 wherein the p-channel transistor of the second sub-branch has a source and drain, and wherein the n-channel transistor of the second sub-branch has a drain coupled to the drain of the p-channel transistor of the second sub-branch.

21. A reference voltage generator in accordance with claim 19 wherein the p-channel transistor of the third sub-branch has a source and drain, and wherein the n-channel transistor of the third sub-branch has a drain coupled to the drain of the p-channel transistor of the third sub-branch.

22. A reference voltage generator in accordance with claim 19 wherein the p-channel transistor of the first sub-branch has a source and drain, and wherein the n-channel transistor of the first sub-branch has a drain coupled to the drain of the p-channel transistor of the first sub-branch.

23. A reference voltage generator in accordance with claim 19 wherein the p-channel transistor of the fourth sub-branch has a source and drain, and wherein the n-channel transistor of the fourth sub-branch has a drain coupled to the drain of the p-channel transistor of the fourth sub-branch.

24. A PTAT current source comprising:

a first branch including a bipolar transistor structure configured to act as a diode, and first and second sub-branches coupled to the bipolar transistor structure, the first sub-branch including a p-channel MOSFET transistor configured to act as a diode and having a gate, a source, and a drain, and an n-channel MOSFET transistor not configured to act as a diode and having a gate, a source, and a drain, and the second sub-branch including a p-channel MOSFET transistor not configured to act as a diode and having a gate, a source, and a drain, and an n-channel MOSFET transistor configured to act as a diode and having a gate, a source, and a drain; and a second branch including a bipolar transistor structure configured to act as a diode, third and fourth sub-branches coupled to the bipolar transistor structure, the bipolar transistor structure of the second branch including in parallel a multiple of bipolar transistors of the size of the bipolar transistor, the third sub-branch including a p-channel MOSFET transistor configured to act as a diode and having a gate, a source, and a drain, and an n-channel MOSFET transistor which is not configured to act as a diode and having a gate, a source, and a drain, and the fourth sub-branch including a p-channel MOSFET transistor not configured to act as a diode and having a gate, a source, and a drain, and an n-channel MOSFET transistor configured to act as a diode and having a gate a source, and a drain, and the second branch further including a resistor coupled between the bipolar structure of the second branch and the third and fourth sub-branches, the drain of the n-channel transistor of the third sub-branch being coupled to the drain of the p-channel transistor of the third sub-branch, the drain of the n-channel transistor of the first sub-branch being coupled to the drain of the p-channel transistor of the first sub-branch, the drain of the n-channel transistor of the fourth sub-branch being coupled to the drain of the p-channel transistor of the fourth sub-branch, the gate of the p-channel transistor of the second sub-branch being coupled to the gate of the p-channel transistor of the fourth sub-branch and defining a first node the gate of the n-channel transistor of the first sub-branch being coupled to the gate of the n-channel transistor of the third sub-branch, the gate of the p-channel transistor of the first sub-branch defining a second node and being coupled to the gate of the p-channel transistor of the third sub-branch, the sources of the p-channel transistors of the first, second, third, and fourth sub-branches being coupled together, the source of the n-channel transistor of the first sub-branch being coupled to the source of the n-channel transistor of the second sub-branch, and the source of the n-channel transistor of the third sub-branch being coupled to the source of the n-channel transistor of the fourth sub-branch; and current mirror circuitry including a first transistor, having a gate coupled to the first node, configured to mirror current produced at the first node, and including a second transistor, having a gate coupled to the second node, configured to mirror current produced at the second node, the first and second transistors of the current mirror being coupled together to cancel differences in voltages at the first and second nodes and to define a voltage output.

25. A PTAT current source in accordance with claim 24 wherein the MOSFETS in the first and second branches define first and second current feedback loops acting in opposite directions on a common node.

26. A PTAT current source in accordance with claim 24 wherein the number of MOSFETS in the first branch is exactly equal to the number of MOSFETS in the second branch.

27. A method of providing a temperature compensated reference voltage, the method comprising:

defining a PTAT current source comprising first and second branches respectively having MOSFET transistors, and arranging the MOSFET transistors such that channel length modulation effects caused by MOSFET transistors in the first branch are cancelled by MOSFETS in the second branch, and such that the MOSFET transistors of the first and second branches together define first and second opposing feedback loops which converge at a common node; and mirroring current from the common node to an output branch including a resistor in series with a bipolar transistor configured to act as a diode.

28. A method of providing a temperature compensated reference voltage, the method comprising:

defining a PTAT current source comprising first and second branches respectively having MOSFET transistors, the MOSFET transistors of the first branch including a p-channel transistor configured to act as a diode, a p-channel transistor not configured to act as a diode, an n-channel transistor configured to act as a diode, and an n-channel transistor not configured to act as a diode, the MOSFET transistors of the second branch including a p-channel transistor configured to act as a diode, a p-channel transistor not configured to act as a diode, an n-channel transistor configured to act as a diode, and an n-channel transistor not configured to act as a diode, the MOSFET transistors of the first and second branches together defining first and second opposing feedback loops which converge at a common node; and mirroring current from the common node to an output branch including a resistor in series with a bipolar transistor configured to act as a diode.

* * * * *